US009458620B2

(12) United States Patent
Sevtsuk et al.

(10) Patent No.: US 9,458,620 B2
(45) Date of Patent: Oct. 4, 2016

(54) GRID STRUCTURE

(71) Applicant: Singapore University of Technology and Design, Singapore (SG)

(72) Inventors: Andres Sevtsuk, Singapore (SG); Raul Kalvo, Singapore (SG)

(73) Assignee: Singapore University of Technology and Design, Singapore (SG)

( * ) Notice: Subject to any disclaimer, the term of this patent is extended or adjusted under 35 U.S.C. 154(b) by 0 days.

(21) Appl. No.: 14/777,244

(22) PCT Filed: Mar. 17, 2014

(86) PCT No.: PCT/SG2014/000132

§ 371 (c)(1),
(2) Date: Sep. 15, 2015

(87) PCT Pub. No.: WO2014/142763

PCT Pub. Date: Sep. 18, 2014

(65) Prior Publication Data

US 2016/0024780 A1 Jan. 28, 2016

Related U.S. Application Data

(60) Provisional application No. 61/789,380, filed on Mar. 15, 2013.

(51) Int. Cl.
*E04B 1/32* (2006.01)
*E04B 7/10* (2006.01)

(52) U.S. Cl.
CPC ..... *E04B 1/32* (2013.01); *E04B 7/105* (2013.01); *E04B 2001/327* (2013.01); *E04B 2001/3223* (2013.01); *E04B 2001/3252* (2013.01); *E04B 2001/3288* (2013.01)

(58) Field of Classification Search
CPC ..... E04B 1/32; E04B 2001/3252; E04B 2001/3288; E04B 2001/3223
USPC ..... 52/474
See application file for complete search history.

(56) References Cited

U.S. PATENT DOCUMENTS 2,918,992 A * 12/1959 Gelsavage ..... E04B 1/3211 135/87
3,203,144 A * 8/1965 Fuller ..... E04B 1/3211 52/537

(Continued)

FOREIGN PATENT DOCUMENTS

FR 2678044 A1 * 12/1992 ..... E04H 1/1272

OTHER PUBLICATIONS

International Search Report dated Apr. 16, 2014 for related PCT Patent Application No. PCT/SG2014/000132, which was filed Mar. 17, 2014; 5 pages.

*Primary Examiner* — Mark Wendell
*Assistant Examiner* — Keith Minter
(74) *Attorney, Agent, or Firm* — Hovey Williams LLP

(57) ABSTRACT

A grid structure formed from a plurality of building blocks, the grid structure comprising: a plurality of flat panels, wherein two of the plurality of flat panels are paired in parallel to have one of the two parallel flat panels provide an inner surface to one building block from the plurality of building blocks and the other of the two parallel flat panels provide an inner surface to another building block from the plurality of building blocks, wherein within each of the plurality of building blocks, the inner surfaces of any two adjacent panels lie on planes intersecting along a straight line that passes through an inner corner of the building block.

20 Claims, 14 Drawing Sheets

(56) References Cited

U.S. PATENT DOCUMENTS 3,255,556 A * 6/1966 D Amato ..... E04B 1/3211 52/482
4,071,985 A 2/1978 Wickwire
4,701,131 A * 10/1987 Hildebrandt ..... A63F 9/12 434/211
4,711,057 A * 12/1987 Lew ..... E04B 1/3211 52/609
4,807,408 A 2/1989 Lew et al.
5,261,194 A * 11/1993 Roberts ..... E04B 1/3211 52/285.1
5,452,555 A * 9/1995 Lee ..... E04B 1/3211 403/388
6,282,849 B1 * 9/2001 Tuczek ..... E04B 1/32 52/648.1
6,295,785 B1 * 10/2001 Herrmann ..... E04B 1/3211 52/639
8,365,474 B2 * 2/2013 McSweeney ..... E04B 1/3211 52/81.1
9,103,110 B1 * 8/2015 Gerber ..... E04B 1/3211
2002/0059777 A1 5/2002 Saebi
2010/0162637 A1 7/2010 Brell-Cokcan
2012/0247054 A1 * 10/2012 Schneider ..... E04B 1/32 52/653.1

* cited by examiner

GRID STRUCTURE

RELATED APPLICATIONS

This application is a national stage application, under 35 U.S.C. §371 of International Patent Application No. PCT/SG2014/000132, filed on Mar. 17, 2004 and published as WO 2014/142763 on Sep. 18, 2014, which claims priority to U.S Provisional Patent Application No. 61/789,380, filed on Mar. 15, 2013, which is hereby incorporated by reference in its entirety.

TECHNICAL FIELD

The invention relates to a grid structure, a method for determining geometry of a flat panel, and a method for forming a grid structure.

BACKGROUND

Grid structures are lattice structures that can span over relatively large spaces using little material compared to conventional wall-ceiling or column-beam structures. Grid structures in the form of gridshells have been widely used to construct hangars, domes, and pavilions that require uninterrupted covered space. Gridshells save material by using double-curved surfaces that follow the lines of structural thrust, thereby achieving economical, efficient and elegant structures.

The use of double-curved surfaces, however, also introduces considerable challenges for the design and fabrication of such grid structures. Freeform gridshells tend to produce variable and complex structural joints between load-bearing beams. For example in parabolic or otherwise variable curvature, unique joints are required at every node of the gridshell.

Conventionally, there are several ways of achieving variable curvature in such structures. One of the commonly used methods requires the fabrication of unique angled joints. As shown in FIG. 14, the structural beams may be straight. The curvature of the gridshell is achieved through the use of a large number of uniquely angled joints, for example ball joints, at every node of the gridshell for joining the straight structural beams. Constructing such joints is costly, requires strong materials (e.g. steel), and requires advanced machinery capable of milling customised three-dimensional elements.

Another conventional method requires restricting the grid to a rectangular grid, i.e. subdividing a complex curved form into a grid of X and Y structural axes. As shown in FIG. 15, flat beams follow the axes and connect structurally at intersections. In this method, each flat beam is required to be uniquely cut in accordance with the curvature of the section it is to be fitted. The method is not suitable for line networks composed of irregular n-gons.

In yet another method as shown in FIG. 16, the gridshell is formed from a plurality of long continuous beams. The plurality of long continuous beams are typically connected into a flat grid on the ground, and then gradually erected into shape by pushing in the, supporting edges on site. This requires space and supporting ground, setting constraints on where such structures can be built. The continuity of the members further restricts the kinds of line networks that can be used in this method. For example, the method is not suitable for line networks composed of irregular n-gons. There are also important constraints in the erection of such gridshells.

In another method as shown in FIG. 17, the gridshell curvature is achieved through the use of curved structural beams with uniquely cut edges for joining with other curved structural beams. In this method, the curved structural beams typically require 3D fabrication, which can be costly and restrictive.

A need therefore exists to provide a grid structure which will overcome at least some of the limitations of the above conventional methods.

SUMMARY

According to one aspect, there is provided a grid structure formed from a plurality of building blocks, the grid structure comprising: a plurality of flat panels, wherein two of the plurality of flat panels are paired in parallel to have one of the two parallel flat panels provide an inner surface to one building block from the plurality of building blocks and the other of the two parallel flat panels provide an inner surface to another building block from the plurality of building blocks, wherein within each of the plurality of building blocks, the inner surfaces of any two adjacent panels lie on planes intersecting along a straight line that passes through an inner corner of the building block.

BRIEF DESCRIPTION OF THE DRAWINGS

Example embodiments of the invention will be better understood and readily apparent to one of ordinary skill in the art from the following written description, by way of example only, and in conjunction with the drawings. The drawings are not necessarily to scale, emphasis instead generally being placed upon illustrating the principles of the invention, in which.

DEFINITIONS

The following provides sample, but not exhaustive, definitions for expressions used throughout various embodiments disclosed herein.

Figure 1A:
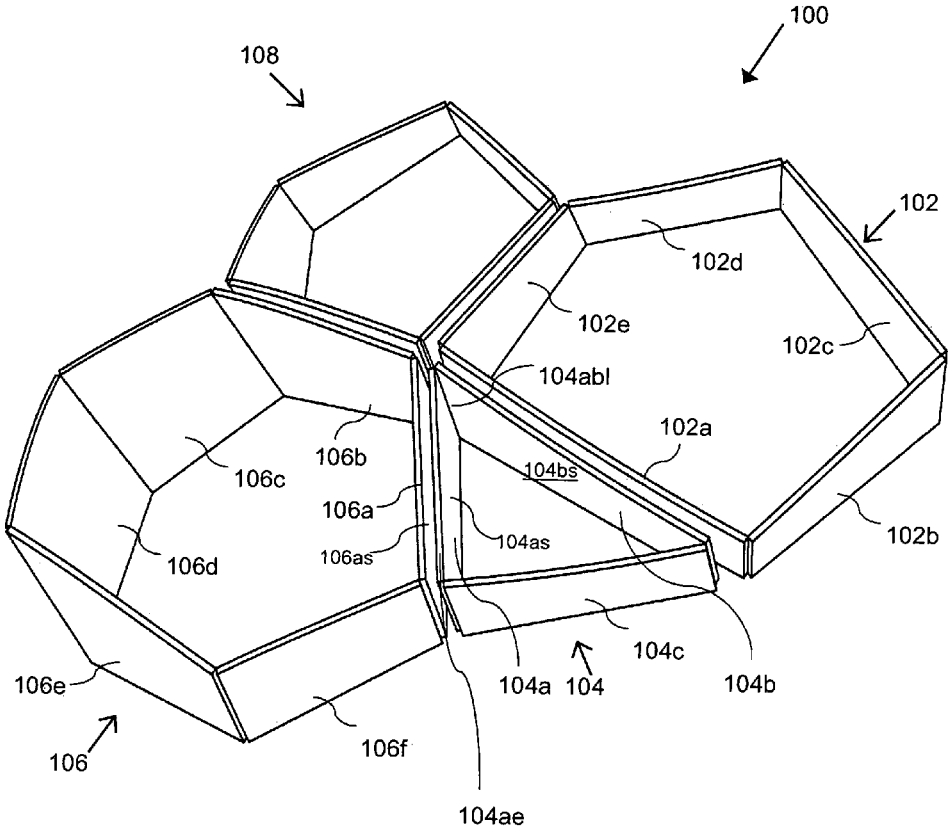
FIGS. 1A and 1B respectively show a perspective view and a top view of a grid structure 100 according to a first embodiment.

The term "grid structure" may refer to a lattice structure that can span over space using little material compared to conventional wall-ceiling or column-beam structures. Grid structures in the form of gridshells are used to construct hangars, domes and pavilions that require uninterrupted covered space. Gridshells save material by using double-curved surfaces that follow the lines of structural thrust. To illustrate, FIG. 1A shows a grid structure 100 that is built in accordance to one embodiment.

The term "building block" may mean a basic structure coupled with other such basic structures to form the grid structure, each such basic structure providing a unit of construction. In various embodiments, the building block is made from flat panels coupled together to enclose a loop, whereby the shape of the building block depends on the number of panels used to enclose the loop. With reference to FIG. 1A, there are a total of four building blocks 102, 104, 106, 108. The building blocks 102 and 108 have five flat panels or walls to form a pentagonal shaped structure. The building blocks 104 and 106 each have three and five flat panels or walls to form triangular and pentagonal shaped structures respectively. It is understood that a building block may have n number of flat panels or walls to form an n-gon shaped structure. Accordingly, FIG. 1A illustrates possible embodiments of building blocks that realise a grid structure.

The term "flat panel" may mean a board having any number of surfaces, wherein at least a pair of surfaces, with the largest area amongst all the other surfaces, are on opposing surfaces. With reference to FIG. 1A, reference 104*as* denotes one of the pair of such opposing surfaces, having the largest area, for one panel 104*a*. When two flat panels (such as 104*a* and 106*a* in FIG. 1A) are paired in parallel, so that one of the two panels 104*a* provides an inner surface 104*as* of one building block 104, while the other panel 106*a* provides an inner surface 106*as* of another building block 106, one of the surfaces 104*asl* with the largest area from one of two such panels 104*a* will face a corresponding surface 106*as* from the other of the two panels 106*a*, the corresponding surface 106*as* being a surface with the largest surface area of the other panel 106*a*. The opposing surfaces (for example, 104*as* for the panel 104*a*) with the largest area also preferably each lie on parallel planes which are planar, thereby giving the board its flat property. In the embodiment as shown in FIG. 1A, the opposing surfaces (104*as* for the panel 104*a*) with the largest area are in the form of a quadrilateral. In another embodiment (not shown), the opposing surfaces (with the largest area) may be in any other regular or irregular shape.

The term "paired in parallel" may refer to two flat panels (for example 104*a*, 106*a* in FIG. 1A) being arranged in a parallel manner such that planes of the largest surface area on each flat panel do not intersect. In other words, the sides with the largest surface area on both of the paired panels are parallel to each other. In various embodiments, the arrangement is such that the resulting structure will have two opposing surfaces that each provides an inner surface of one of two different building blocks. Throughout the entire specification, the phrase "two of the flat panels are paired in parallel" is used interchangeably with the phrase "two parallel flat panels".

The phrase "one of the two parallel flat panels provide an inner surface to one building block from the plurality of building blocks and the other of the two parallel flat panels provide an inner surface to another building block from the plurality of building blocks" may mean that parallel flat panels are used to form a wall of the grid structure. One of the two panels of the parallel flat panels belongs to one building block, while the other of the two panels of the parallel flat panels belongs to another building block, so that each wall of the grid structure is shared by two adjacent building blocks.

The phrase "wherein within each of the plurality of building blocks, the inner surfaces of any two adjacent panels lie on planes intersecting along a straight line that passes through an inner corner of the building block" may mean that two flat panels of the same building block (for example 104*a* and 104*b* in FIG. 1A) converge to form a corner of the building block. Each of the respective inner surfaces 104*as*, 104*bs* of the two flat panels 104*a* and 104*b* intersect along a straight line 104*abl*. The straight line 104*abl* passes through the corner of the building block 104 where the two flat panels 104*a*, 104*b* converge.

The phrase "wherein at a location where the corners of two or more of the plurality of building blocks meet, the straight lines that pass through the inner corners of adjacent building blocks each lie on axes that have different angles to one another" may mean near the vicinity of a point in which corners of at least two or more of the plurality of building blocks (for example see FIG. 2, building blocks 204, 202) converge, the straight lines 204*bcl*, 202*abl*, that each pass through a respective corner of at least two or more of the plurality of building blocks, lie on axes that may not be parallel.

The term "polygonal structure" may mean any n-gonal shape structure made from building blocks having any number (n) of flat panels. Each building block in the same grid structure can contain a number of panels to form a shape, where both the number of panels and shape are different than those of another building block in the same grid structure. Possible polygonal structures include, but are not limited to, triangular, quadrilateral, pentagonal, hexagonal and octagonal structures.

DETAILED DESCRIPTION

In the following description, various embodiments are described with reference to the drawings, where like reference characters generally refer to the same parts throughout the different views.

Figure 1B:
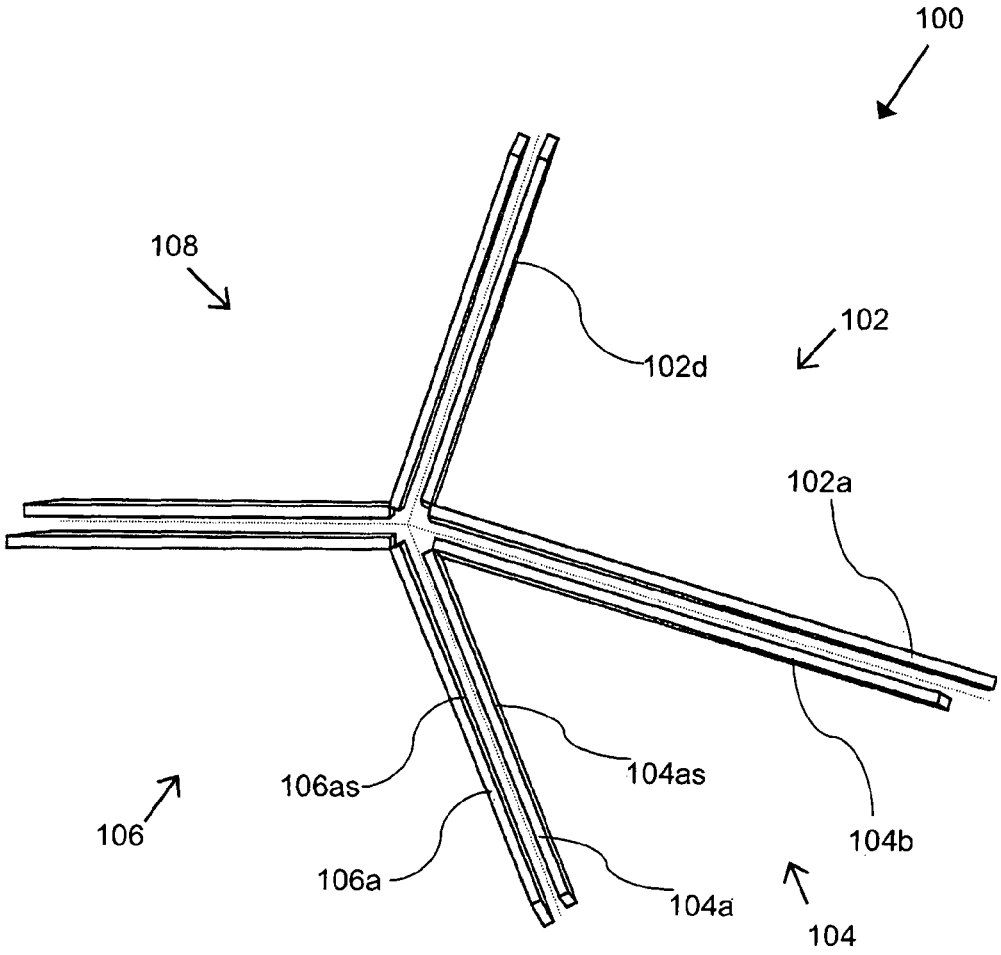

FIGS. 1A and 1B respectively show a perspective view and a top view of a grid structure 100 according to a first embodiment. FIG. 1B shows a top view of a centre portion of the grid structure 100 shown in FIG. 1A. It is understood that the grid structure 100 may be a gridshell structure.

The grid structure 100 is formed from a plurality of building blocks 102, 104, 106, 108. In this embodiment, the plurality of building blocks 102, 104, 106, 108 are of various shape. Building blocks 102 and 108 each include five flat panels or walls forming a pentagonal shaped structure. Building block 104 includes three flat panels or walls forming a triangular shaped structure. Building block 106 includes six flat panels or walls forming a hexagonal shaped structure. It is understood that a building block may have any number of flat panels or walls to form triangular, quadrilateral, pentagonal, hexagonal or n-gon shaped structures. FIG. 1A is provided by way of an example only.

The plurality of building blocks 102, 104, 106, 108 each comprises a plurality of flat panels. For example the first building block 102 includes a first flat panel 102*a*, a second flat panel 102*b*, a third flat panel 102*c*, a fourth flat panel 102*d* and a fifth flat panel 102*e*. The second building block 104 includes a first flat panel 104*a*, a second flat panel 104*b* and a third flat panel 104*c*. The third building block 106 includes a first flat panel 106*a*, a second flat panel 106*b*, a third flat panel 106*c*, a fourth flat panel 106*d*, a fifth flat panel 106*e* and a sixth flat panel 106*f*. The plurality of flat panels allows for the gridshell structure 100 to be realised using flat material that employs only two dimensional cutting techniques (e.g. saws, laser-cutters, 2D CNC routers). It is understood that by two dimensional cutting of sheet material, the sides of the flat panel are substantially flat and are perpendicular to the largest surfaces (for example 104*as*, 106*as*) of the flat panels.

As shown in FIG. 1B, two of the plurality of flat panels, for example 104*a* and 106*a*, are paired in parallel to have one 104*a* of the two parallel flat panels 104*a* and 106*a* provides an inner surface 104*as* to one building block, such as the second building block 104, from the plurality of building blocks 102; 104, 106, 108. The other 106*a* of the two parallel flat panels 104*a* and 106*a* provides an inner surface 106*as* to another building block, such as the third building block 106, from the plurality of building blocks 102, 104, 106, 108. This arrangement allows the grid structure to have double walled panels along each edge of a line-network defining the grid structure.

In an embodiment, the two parallel flat panels 104*a*, 106*a* may be connected by a spacer disposed between the two parallel flat panels 104*a*, 106*a*. In another embodiment, the two parallel flat panels 104*a*, 106*a* may be directly connected.

Within each of the plurality of building blocks, such as the second building block 104, two of the inner surfaces 104*as*, 104*bs* of two adjacent panels 104*a*, 104*b* lie on planes intersecting along a straight line 104*abl* that passes through an inner corner of the building block. Advantageously, the double walled panels and the straight line 104*abl*, being independent of other straight lines passing through other corners of other building blocks around a network node closest to 104*abl*, allows the flexibility of realising almost any grid structure, including a grid structure with a curved line network or a double-curved gridshell structure, with the use of flat panels. Two or more of the straight lines, each passing through adjacent building block corners around a network node, lie on axes that may be nonparallel. In contradistinction, for prior art grid structures that are formed from a plurality of edges using single walled panels, all edges that meet at a corner of a network node, meet in a single point and must therefore be extruded parallel to each other. Having the same panel being shared by two adjacent loops restricts the flexibility of such prior art grid structures from realising a grid structure with a curved line network.

In an embodiment, the two adjacent flat panels 104*a*, 104*b*, providing the two inner surfaces 104*as*, 104*bs* that lie on planes intersecting along a straight line 104*abl* that passes through the inner corner of ,the building block 104, are coupled together by a joint selected from the group comprising a hinge, a weld, a fold, an adhesive, and a fastener.

Referring back to FIG. 1A, each of the plurality of flat panels, for example 104*a*, 104*b*, 104*c*, include two opposite edges (for example 104*ae* for flat panel 104*a*) that connect two corners of each of the plurality of building blocks. In this embodiment, the two opposite edges may be parallel because the flat panel has a trapezoidal shape. In other embodiment, the two opposite edges may be curved, straight or have an irregular form.

Figure 2:
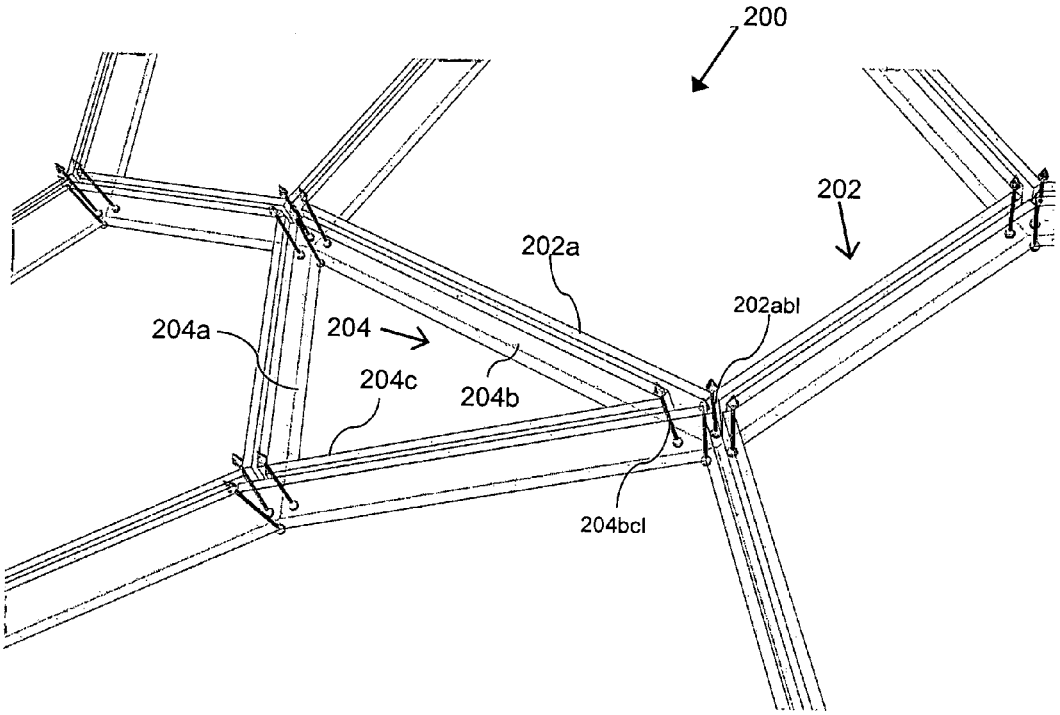
FIG. 2 shows a perspective view of a portion of a grid structure according to a second embodiment.

FIG. 2 shows a perspective view of a portion of a grid structure 200 according to a second embodiment. As shown, at a location where the corner of two of the plurality of building blocks 202, 204 meet, the straight line 204*bcl* that passes through the corner of one of the two building blocks 204 lies on an axis that may have a different angle and that may not be parallel to the straight line 202*abl* that passes through the corner of the other of the two building blocks 202. Advantageously, the nonparallel straight lines 204*bcl*, 202*abl* passing through different corners of different building blocks 202, 204 allow curved grid structures to be formed.

As described above, such flat panels are manufactured using two dimensional cutting techniques, omitting the requirement to use complex joints that require three dimensional fabrication techniques to realize such double-curved gridshell structures. In two dimensional cutting, each flat panel may be perpendicularly cut. In other words, the perimeter of each of the plurality of flat panels is derived from a perpendicular cut.

Consider prior art techniques, which also use flat panels to realise double-curved gridshell structures, but have each flat panel shared by two adjacent nodes. The shape and curvature constraints that such prior art techniques face to realise double-curved structures because each flat panel is shared by two adjacent loops is alleviated by using the two parallel flat panels, for example 104*a* and 106*a*, as described above.

Figure 3:
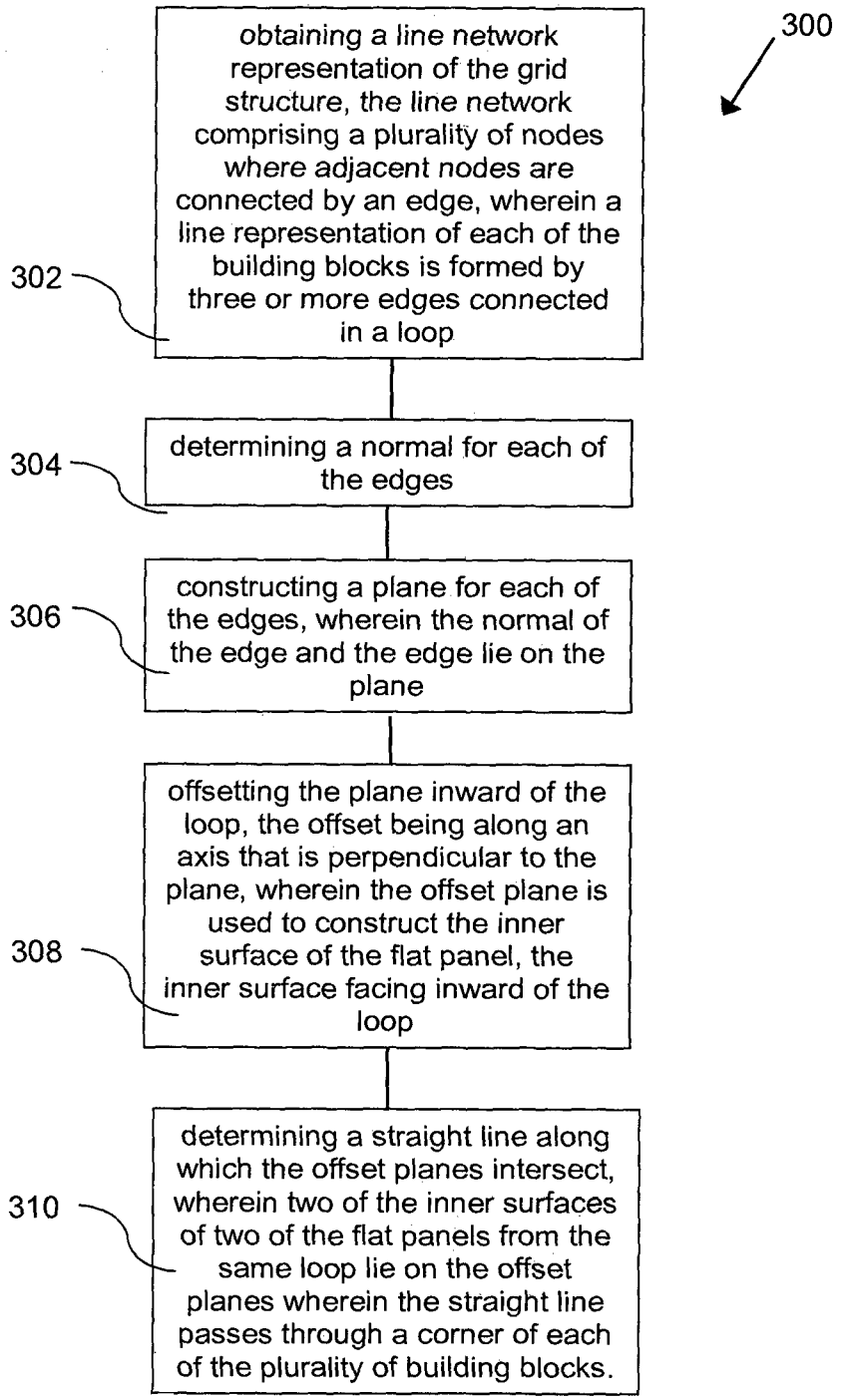
FIG. 3 shows a flow chart illustrating a generalised method for determining geometry of a flat panel according to an example embodiment.

FIG. 3 shows a flow chart 300 illustrating a generalised method for determining geometry of a flat panel, wherein two of a plurality of flat panels are paired in parallel to have one of the two parallel flat panels provide an inner surface to one building block from a plurality of building blocks of a grid structure and the other of the two parallel flat panels provide an inner surface to another building block from the plurality of building blocks of the grid structure. At step 302, a line network representation of the grid structure is obtained. The line network comprises a plurality of nodes where adjacent nodes are connected by an edge, wherein a line representation of each of the building blocks is formed by three or more edges connected in a loop. At step 304, a normal for each of the edges is determined. At step 306 a plane for each of the edges is constructed, wherein the normal of the edge and the edge lie on the plane. At step 308 the plane is offset inward of the loop, the offset being along an axis that is perpendicular to the plane, wherein the offset plane is used to construct the inner surface of the flat panel, the inner surface facing inward of the loop. At step 310, a straight line along which the offset planes intersect is determined, wherein two of the inner surfaces of two of the adjacent flat panels from the same loop lie on the offset planes. The straight line passes through an inner corner of each of the plurality of building blocks.

FIGS. 4A-4E show schematic diagrams for illustrating the method for determining geometry of a flat panel according to the method above.

Figure 4A:
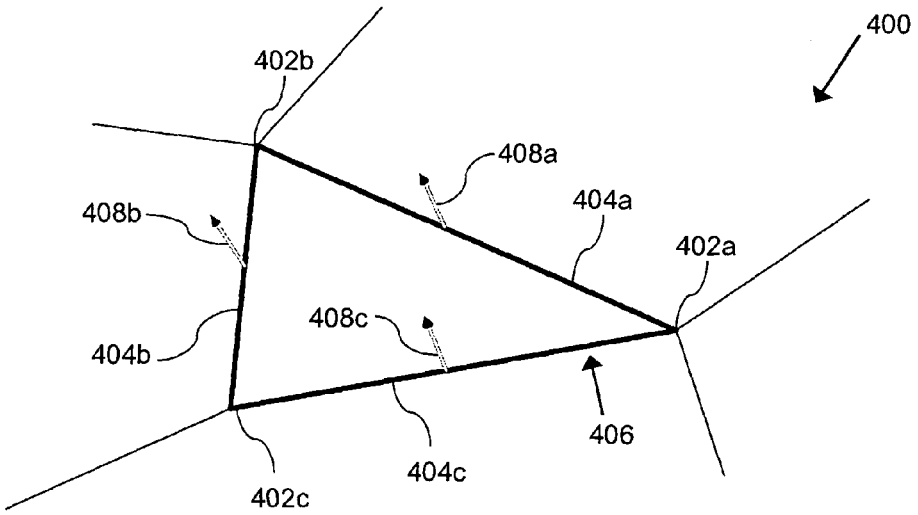
FIGS. 4A-4E show schematic diagrams for illustrating the method for determining geometry of a flat panel according to the method in FIG. 3.

In FIG. 4A, a line network representation of a grid structure 400 is shown. The line network comprises a plurality of nodes 402*a*, 402*b*, 402*c*. Adjacent nodes are connected by an edge. For example, nodes 402*a* and 402*b* are connected by edge 404*a*, nodes 402*b* and 402*c* are connected by edge 404*b*, and nodes 402*c* and 402*a* are connected by edge 404*c*. The edges 404*a*, 404*b* and 404*c* are connected in a loop 406 to form a line representation of a building block for the grid structure 400. In FIG. 4A, the normals 408*a*, 408*b*, 408*c* of respective edges 404*a*, 404*b*, 404*c* are determined.

The normals 408*a*, 408*b*, 408*c* of each of the edges 404*a*, 404*b*, 404*c* may be determined or obtained by first determining the node normals (not shown) on both ends of each of the edges 404*a*, 404*b*, 404*c* based on surface curvature, which is desired, of the grid structure at the respective nodes 402*a*, 402*b*, 402*c*, and averaging the node normals on both ends of each of the edges 404*a*, 404*b*, 404*c* to obtain the normals 408*a*, 408*b*, 408*c* of each of the edges 404*a*, 404*b*, 404*c*. Alternatively, the normals 408*a*, 408*b*, 408*c* of each of the edges 404*a*, 404*b*, 404*c* may be obtained from user input.

Figure 4B:
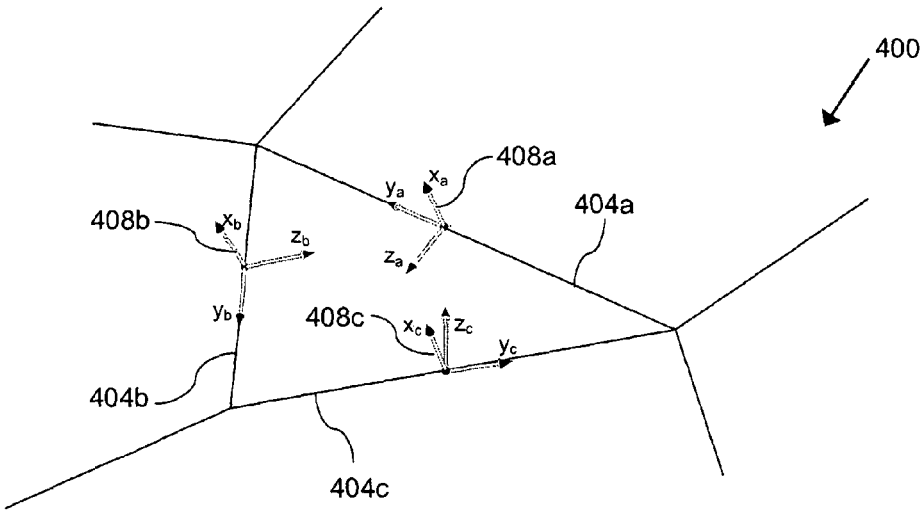

In FIG. 4B, a plane represented by coordinate axes $(x_a,y_a)$, $(x_b,y_b)$ and $(x_c,y_c)$ for each of the edges 404*a*, 404*b*, 404*c* is constructed, wherein the normal 408*a*, 408*b*, 408*c* of each edge and each edge 404*a*, 404*b*, 404*c* lie on the respective plane $(x_a,y_a)$, $(x_b,y_b)$ and $(x_c,y_c)$. FIG. 4B further shows axis $z_a$, $z_b$, $z_c$ to represent a direction inward of the loop 406 from each plane $(x_a,y_a)$, $(x_b,y_b)$ and $(x_c,y_c)$.

Figure 4C:
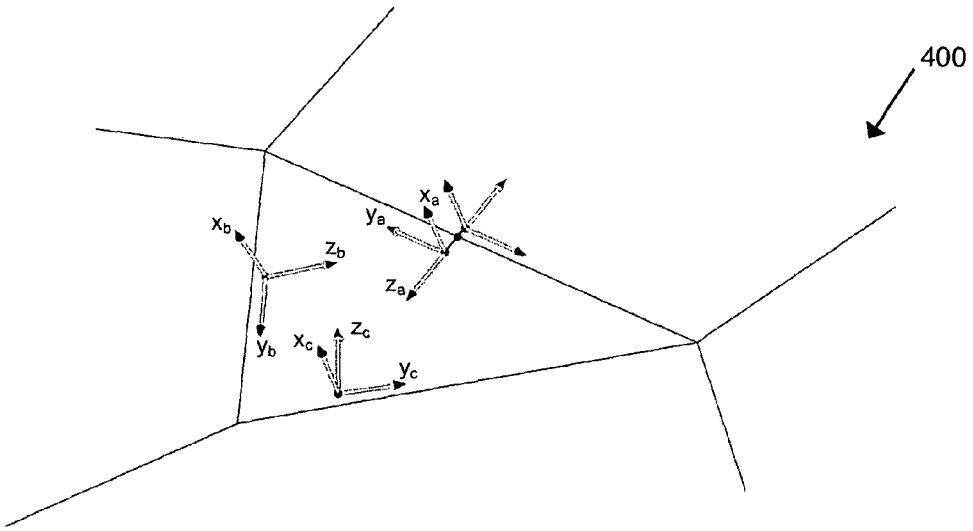

In FIG. 4C, the plane $(x_a,y_a)$, $(x_b,y_b)$ and $(x_c,y_c)$ is offset towards the centre of the loop, the offset being along the axes $z_a$, $z_b$, $z_c$ that is perpendicular to the plane $(x_a,y_a)$, $(x_b,y_b)$ and $(x_b,y_b)$. An amount to offset is determined by taking into consideration a desired thickness of the flat panel and a desired gap between two parallel flat panels, in which one of the two parallel flat panels provides an inner surface to one building block from a plurality of building blocks of a grid structure and the other of the two parallel flat panels provides an inner surface to another building block of the grid structure.

Figure 4D:
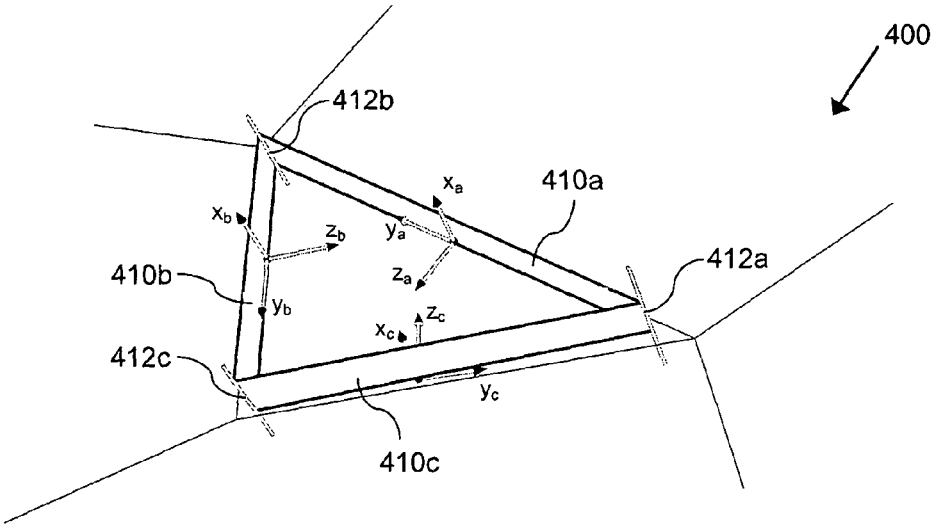

In FIG. 4D, the offset plane $(x_a,y_a)$, $(x_b,y_b)$ and $(x_c,y_c)$ is used to construct a surface of the flat panel 410*a*, 410*b*, 410*c*. At an inner corner of each of the plurality of building blocks, a straight line 412*a*, 412*b*, 412*c* along which offset planes intersect is being determined. Each of an inner surface of two of the adjacent flat panels, from the same loop, lie on each of the offset planes.

Advantageously, the straight lines 412*a*, 412*b*, 412*c* can be used to determine the profile of the sides of the flat panels 410*a*, 410*b* and 410*c*, which can be joined with each other via linear joints to form one of the plurality of building blocks. In other words, the straight line 412*a*, along which the flat panels 410*a* and 410*c* intersect, is used to determine the profile of the respective sides of the flat panels 410*a* and 410*c* such that they may join to form a first corner of the building block. Flat panels 410*a* and 410*b* intersect along straight line 412*b*, and the straight line 412*b* is used to determine the profile of the respective sides of the flat panel 410*a* and 410*b* such that they may join to form a second corner of the building block. Flat panel 410*b* and 410*c* intersect along line 412*c*, and the line 412*c* is used to determine the profile of respective sides of the flat panels 410*b* and 410*c* such that they may join to form a third corner of the building block.

Figure 4E:
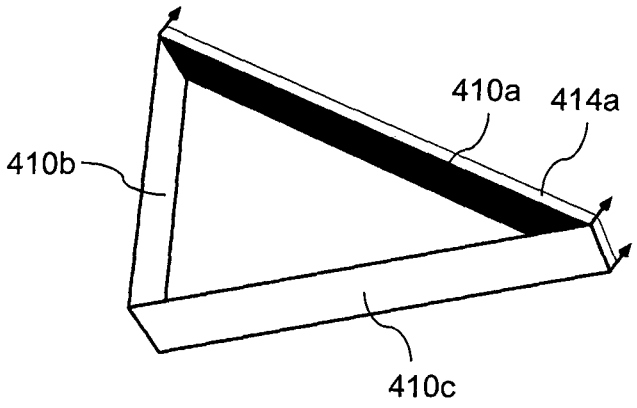

In FIG. 4E, the flat panel 414*a* is extruded from the surface of the flat panel 410*a*, in a direction outward of the loop 406 by the desired thickness of the flat panel to obtain a three dimensional geometry representation of the flat panel 414*a*.

Figure 5:
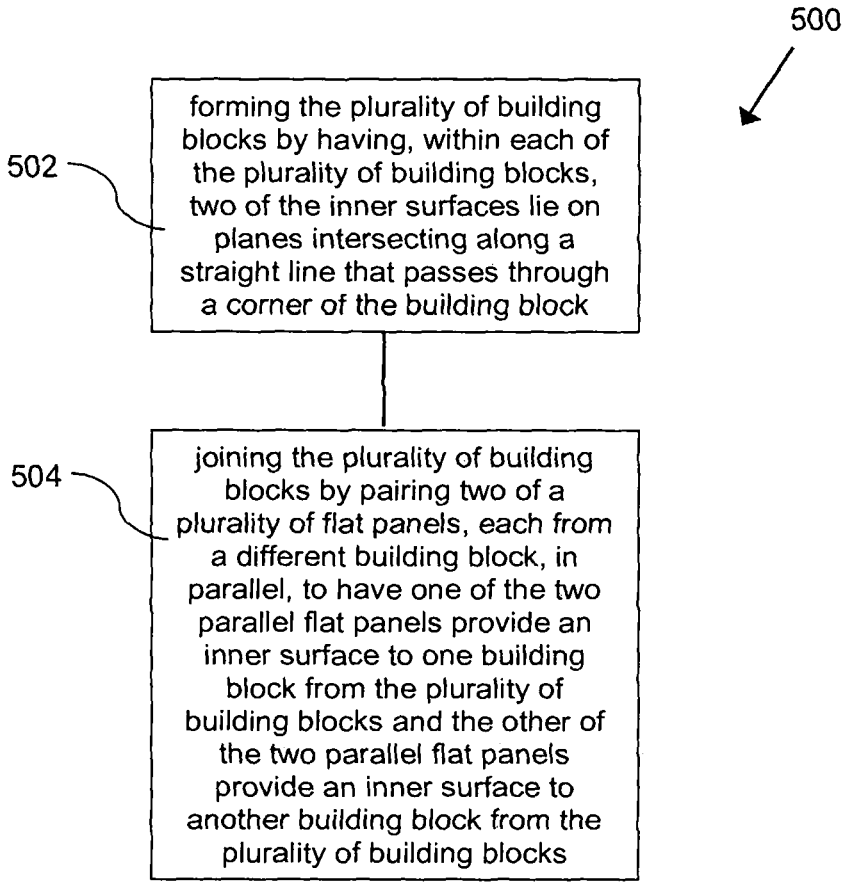
FIG. 5 shows a flow chart illustrating a generalised method for forming a grid structure according to an example embodiment.

FIG. 5 shows a flow chart illustrating a generalised method for forming a grid structure according to an example embodiment. At step 502, a plurality of building blocks is formed by having, within each of the plurality of building blocks, two of the inner surfaces lie on planes intersecting along a straight line that passes through a corner of the building block. At step 504, the plurality of building blocks are joined by pairing two of a plurality of flat panels, each from a different building block, in parallel, to have one of the two parallel flat panels provide an inner surface to one building block from the plurality of building blocks and the other of the two parallel flat panels provide an inner surface to another building block from the plurality of building blocks.

Prior to step 502 above, the method may further comprise the steps of determining geometry of each of the plurality of the flat panels, and cutting sheet material perpendicularly to obtain the flat panel. The step of determining geometry of the flat panel may adopt the method as described above with reference to FIG. 3, and FIGS. 4A-E.

Figure 13:
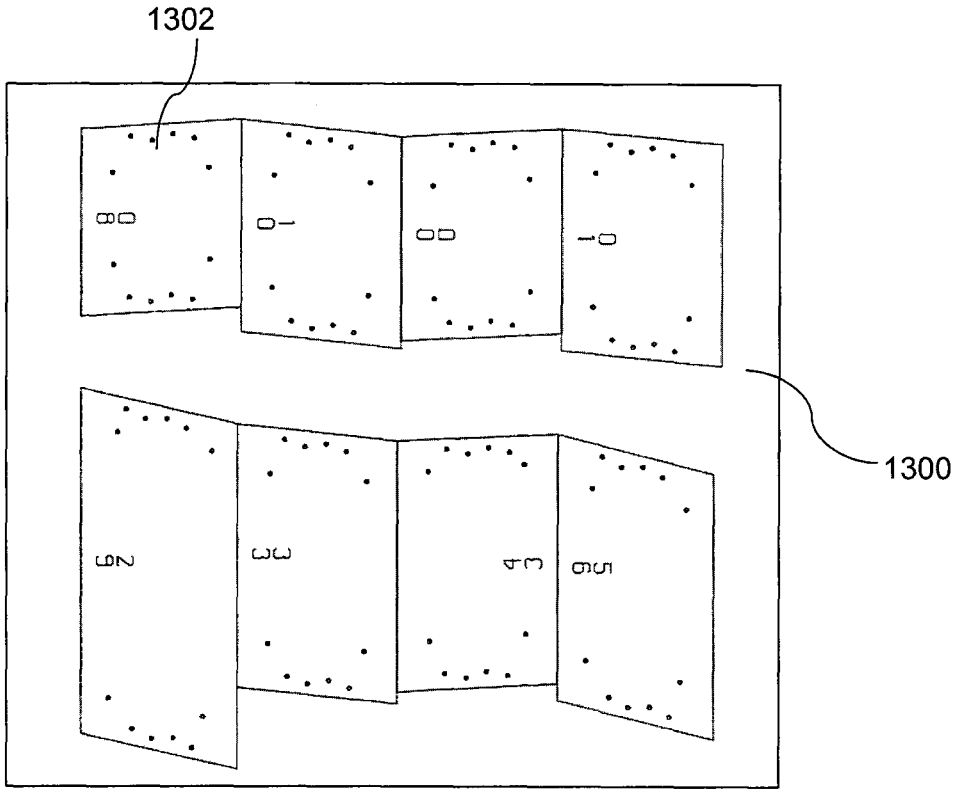
FIG. 13 shows an example of the layout of the plurality of the flat panels for cutting from a sheet material.
Figure 14:
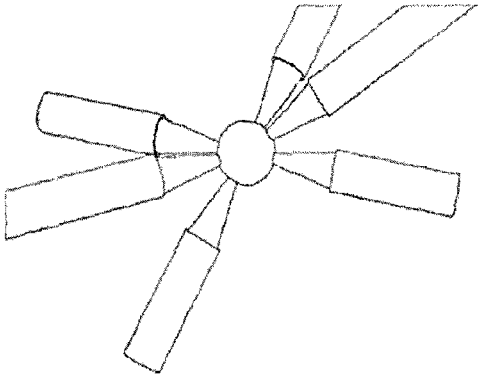
FIG. 14 (prior art)
FIG. 14-17 show prior art grid structures.
Figure 15:
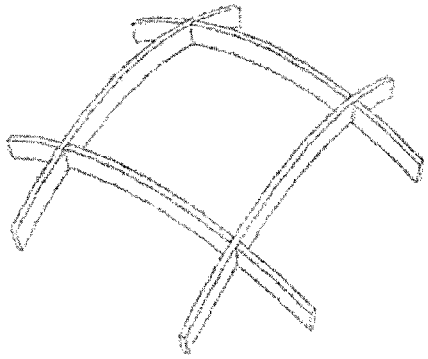
FIG. 15 (prior art)
Figure 16:
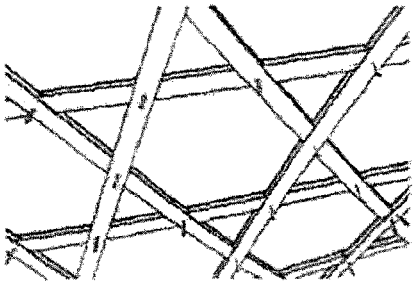
FIG. 16 (prior art)
Figure 17:
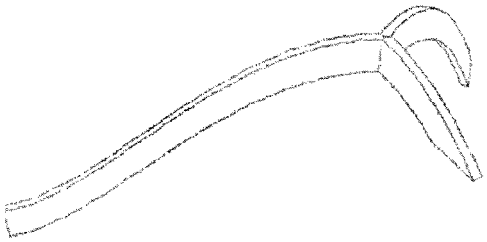
FIG. 17 (prior art)

FIG. 13 shows an example of the layout of the plurality of the flat panels for cutting ,from a sheet material 1300. The holes and number codes shown on each of the panels in FIG. 13 are illustrative only and indicate panel identification codes and holes for fastening hinges to the panels. As can be seen, each of the plurality of the flat panels 1302 is arranged adjacent to each other on the sheet material 1300. Each of the plurality of the flat panels 1302 may then be perpendicularly cut from the sheet material 1300 so that individual pieces of flat panel may be obtained. Such a perpendicular cut is performed by extracting the plurality of the flat panels 1302, from the sheet material 1300, using a cut that is along a plane that is perpendicular to the sheet material 1300 surface, where the cut traces the perimeter of each of the flat panels.

Returning to step 502, in which the plurality of building blocks is formed by having, within each of the plurality of building blocks, two of the inner surfaces of any two adjacent panels lie on planes intersecting along the straight line that passes through the inner corner of the building block, the two flat panels, that provide the two inner surfaces, may be coupled by using a joint selected from the group comprising a hinge, a weld, a fold, an adhesive, and a fastener.

In step 504 above, in which the plurality of building blocks are joined by pairing two of the plurality of flat panels in parallel, a spacer may be disposed between the two parallel flat panels such that the two parallel panels may be connected together with the spacer. In another embodiment, the two parallel panels may be connected directly.

Advantageously, various embodiments of the grid structure, method for determining geometry of a flat panel, and method for forming a grid structure as described above allow the creation of grid structures out of almost any line network comprising regular or irregular n-gons, including gridshell structures and/or curved grid structures with curved line network, in which all beams and joint elements of the grid structure can be fabricated with only two-dimensional cutting technology. The double-walled structures, along network edges of a line-network defining the grid structure, formed by the paired or parallel flat panels have allowed each flat panel to be obtained from simple 2D cutting technology (e.g. saws, laser-cutters, 2D CNC routers).

Further, each flat panel may be coupled to neighboring flat panel along straight intersection lines to form building blocks of various n-gons shaped as described in the various embodiments, allowing flat panels to be structurally connected using simple linear fasteners, such as hinges, welds, folds, corner brackets, adhesives etc.

Embodiments of the grid structure and methods as described above possess significant improvement over the conventional grid structures and methods for creating conventional grid structures which rely on either complex joints between grid structure elements, or complex edge elements that require 3d fabrication technology. (e.g. angular cuts). Accordingly, embodiments of the grid structure and methods described above enable elements (e.g. beams, joints, walls, panels, planes etc.) of a grid structure to be fabricated economically, and enable the grid structure to be assembled from simple, pre-assembled building blocks using unspecialized labor. Instead of relying on high-precision fastening and assembly work on site, common to traditional grid structures, the proposed method achieves flat panels with precise geometric outlines on a computer controlled 2D cutter or saw, which are simple to assemble into building blocks, and building blocks into a grid structure. Furthermore, embodiments of the grid structure and methods as described can turn almost any curved line network into a grid structure, overcoming the significant constraints that limit the shapes and curvatures of single-walled grid structures.

To achieve this, two key features may be necessary. The structure may need to be composed of two parallel walls around each network edge, and the adjoining non-parallel walls in each network loop may need to be extruded at particular angles, such that straight intersection lines are achieved on the interior planes of n-gons. Both features may be necessary to allow 2D fabrication.

Figure 6A:
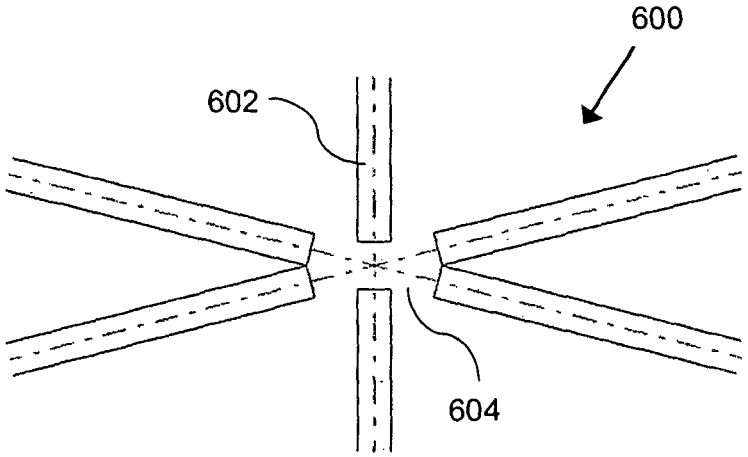
FIG. 6A shows the plan view of an analogous single-wall grid structure form by 2D cut panels.
Figure 6B:
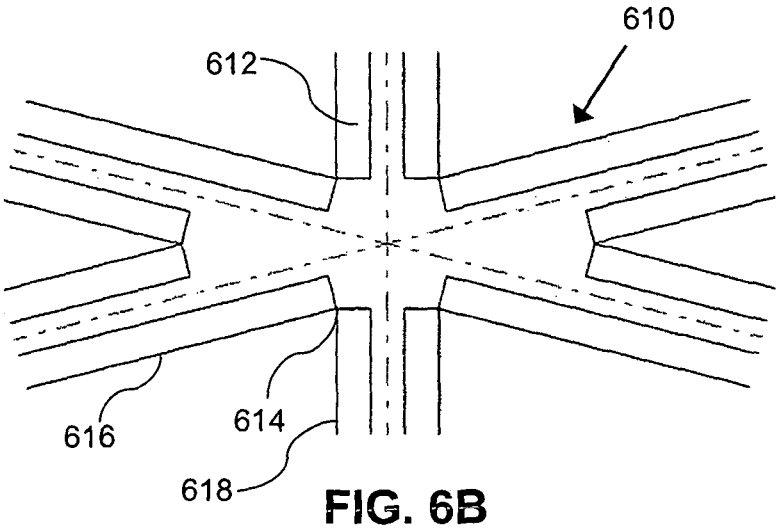
FIG. 6B and 6C show the plan and axonometric view of a double-walled grid structure form by 2D cut panels.
Figure 6C:
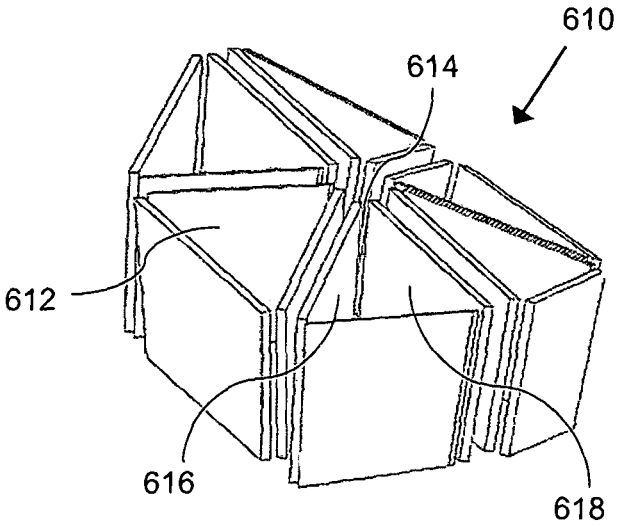

FIG. 6A shows the plan view of an analogous single-wall grid structure 600 form by 2D cut panels 602. As can be seen, it is not feasible to construct a single-wall grid structure with panels 602 fabricated with strictly two dimensional cutting without creating gaps 604 between elements or modifying the input line-network. The FIG. 6B and 6C show the plan and axonometric view of a double-walled grid structure 610 ,form by 2D cut panels 612. FIG. 6B and 6C show in plan and axonometric view how a continuous grid structure 610 is achieved through a double-walled structure around each network edge, where the panels 612 are extruded at such angles that straight intersection lines 614 are achieved within all interior surface planes 616, 618 of the panels of the grid structure loops.

As discussed above, the joints of embodiments of the grid structure are connected along a linear intersection line between two neighbouring planes of grid structure beams or walls, allowing any angles to be joined as long as fasteners can fit between the planes. Since the connection is achieved via intersecting interior planes of the walls, the vertical depth of the walls becomes a structural variable that, can be increased for stronger linear connections. Advantageously, this offers a unique solution for turning almost any curved line network into a gridshell structure in an economical way.

In an implementation, embodiments of the method for determining geometry of a flat panel, and the method for forming a grid structure may be implemented on a computer or any processor. A computer readable medium may have stored thereon computer code means for performing all the steps of embodiments of the methods when said computer code means is run on a computer.

Figure 7:
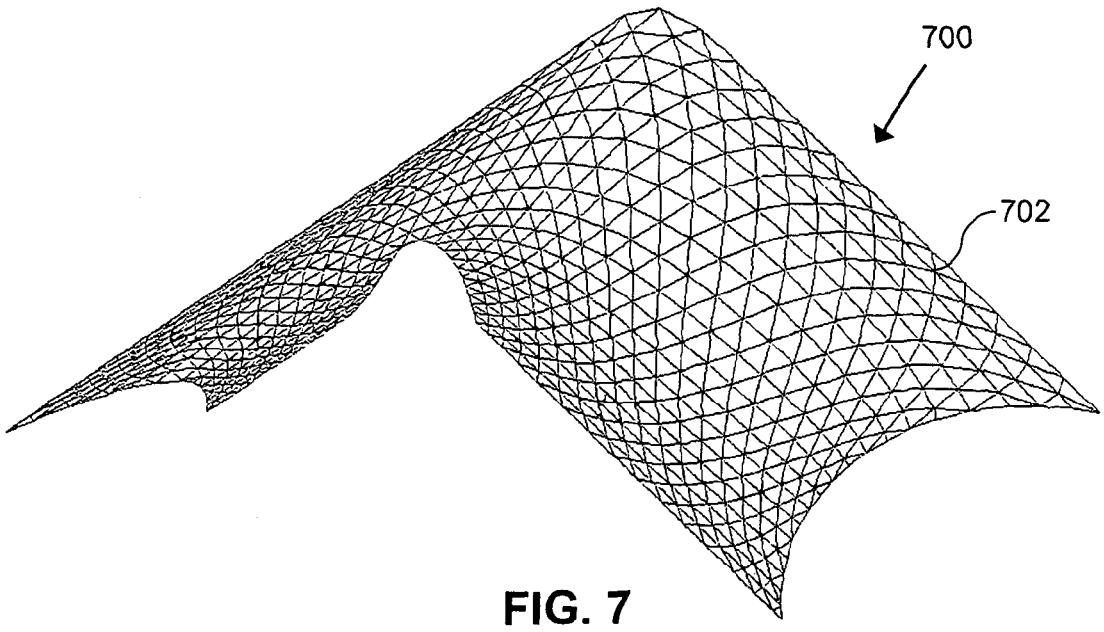
FIG. 7 shows an example of an input curved line-network for forming a grid structure.

FIG. 7 shows an example of an input curved line-network 700 for forming a grid structure such as gridshell structure. When embodiments of the methods are implemented on a computer or a processor, the computation of the gridshell structure starts with one user input—a curved line-network 700. The line-network 700 can follow any surface curvature. All vertices or nodes 702 in the line network may be used as structural joints in the gridshell.

Figure 8:
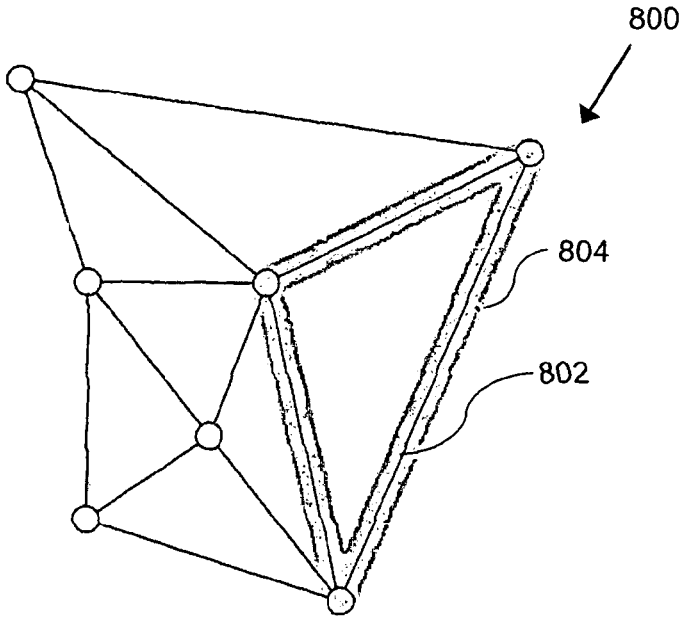
FIG. 8 shows a close up view of a portion of an input line-network.

FIG. 8 shows a close up view of a portion of an input line-network 800. The first step in analysing the input line-network 800 is to detect which combinations of edges 802 form closed loops 804. If three or more edges 802 in the line-network 800 form a cycle, then they are detected as loops 804. It is necessary to know the loops 804 in the line-network 800 in order to find the different extrusion angles for flat structural walls, as explained below.

Figure 9:
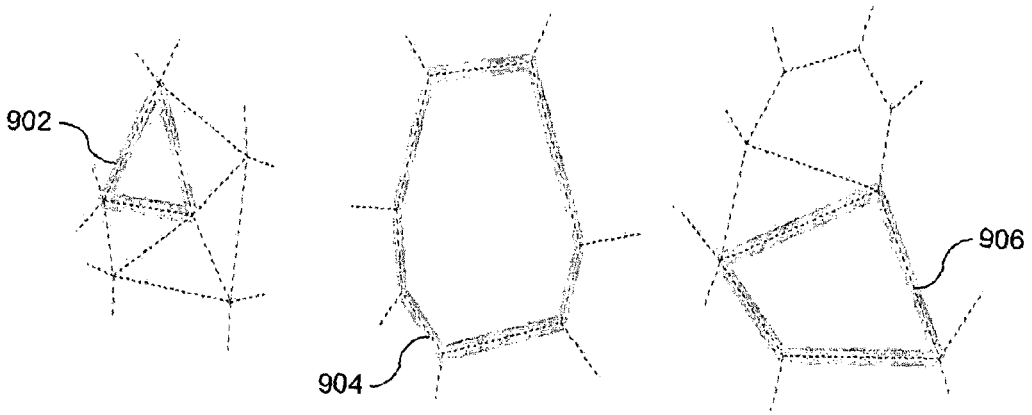
FIG. 9 shows examples of different loops.

Loops can be detected in complex networks on curved three-dimensional surfaces. Loops may comprise of regular or irregular polygons of any size (n-gons) and shape. FIG. 9 shows examples of different loops. For example, triangular loop 902, n-gons loop 904, equilateral loop 906.

After loops have been detected, computation of the geometry of structural panels begins. These panels obtained from computation may eventually be cut out of sheet material on a two-dimensional cutter.

As previously discussed, embodiments of the grid structures form two paired flat panels or double-walled panels along each input network line. Facing panels along the same edge are preferably set completely parallel to each other and the geometries of panels in the same loop that share a corner are extruded such that a straight intersection line is achieved between all neighbouring interior planes of the n-gons, allowing the latter to be fastened with straight connectors (e.g. hinges, welds, folds, corner brackets, adhesives, fasteners etc.).

In this implementation, the computer or processor will determine edge normals (e), loop-edge vectors (d), loop-edge planes (F), and loop-node vectors (l), for the entire input network.

Figure 10:
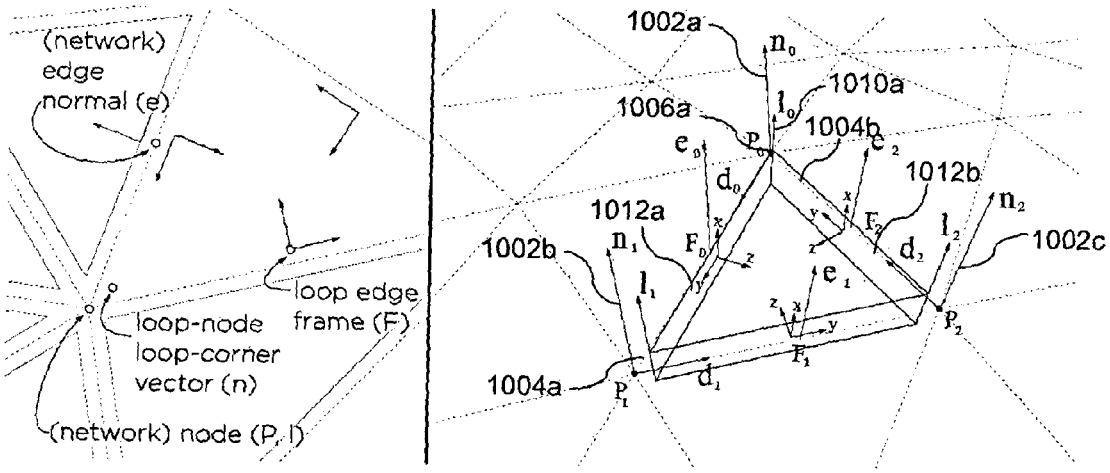
FIG. 10 shows a schematic diagram of the parameters computed according to an example implementation.

FIG. 10 shows a schematic diagram of the parameters computed according to an example implementation.

First, node normals (n) are given from the input line network at the edge intersection points (P). The vectors of node normals are given as the underlying surface normals at points (P).

Second, the node normals at the opposite ends of each original network edge (for example a first normal vector 1002*a* and a second normal vector 1002*b* for a first edge 1004*a,* and for example the first normal vector 1002*a* and a third normal vector 1002*c* for an adjacent second edge 1004*b;* for example, the first normal vector 1002*a* may be the normal vector corresponding to the node 1006*a* that the first edge 1004*a* and the second edge 1004*b* have in common; in other words: where the first edge 1004*a* and the second edge 1004*b* intersect) are used to derive the corresponding edge normal (e). Each edge normal is found as the average of its two endpoints normals: $e_i=(n_i+n_{i+1})/2$.

Next, a loop-edge plane (F) is constructed (for example a first plane for the first edge 1004*a* and a second plane for the adjacent second edge 1004*b*) from the original edge normal (e) and the loop-edge vector (d) for the adjacent second edge 1004*b*) such that that $F_i.x=e_i$, and $F_i.y=d_i$. The normal vector of this plane ($F_i.z$) is used to offset the loop plane inside, by at least the thickness of the construction material (e.g. steel plate). Typically, an additional gap is desirable between the parallel panels in order to leave space for fasteners on both sides of the structural planes.

The loop-node vector (l) is calculated as the intersection line of two adjacent and offset loop-edge planes ($l_i=F_i$ intersection with $F_{i-1}$) (for example as intersection 1010*a* of the first offset plane 1012*a* and the second offset plane 1012*b*). The panels may be cut to resemble the desired shape according to the cutting line. Every loop-node vector (l) is in the same plane with both of its neighbouring loop-edge vectors ($l_i$ is coplanar with $l_{i-1}$ and $l_{i+1}$). These vectors ($l_i$ and $l_{i+1}$) and the loop-edge plane ($F_i$) are used to construct a structural panel, which represents the inner material surface of each loop.

Figure 11:
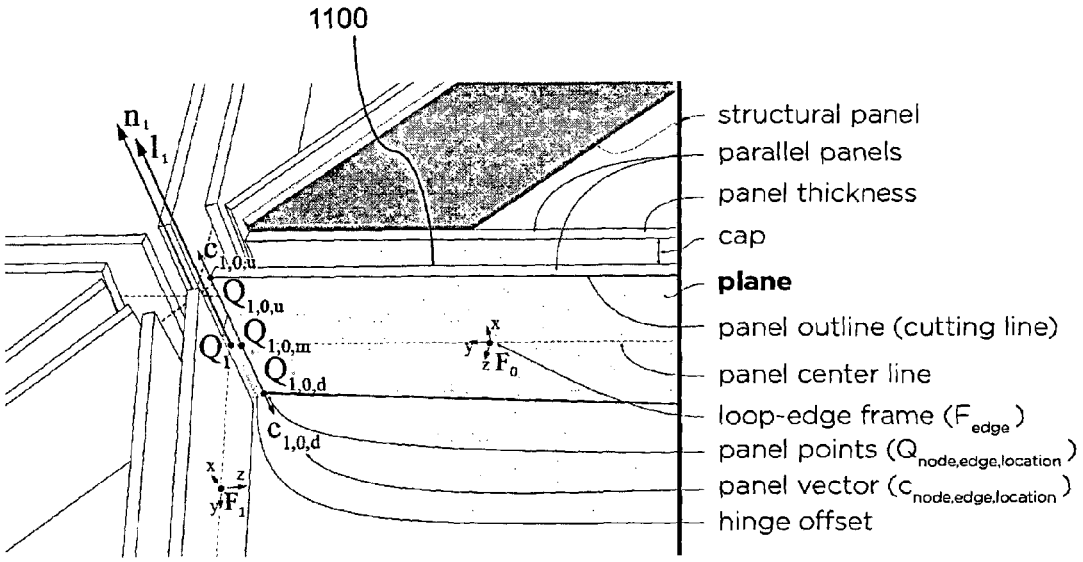
FIG. 11 shows a graphical representation of the extruded panels obtained from the parameters derived from FIG. 10.

The surfaces are extruded outwards from each loop to achieve a desired material thickness for the structural panels. FIG. 11 shows a graphical representation of extruded panels 1100 obtained from the parameters derived above, the extruded panels 1100 being a trapezoidal shaped panel. Since all structural panels 1100 share an inner edge (along vector l the panels may be cut along the determined cutting line so that they fit together using standard linear connectors and so that the boundaries of the panels follow the linear vector l) with their neighbouring edges, they can be joined to each other using standard linear connectors that follow the linear vector (l) on the inner surface of a loop.

Both the desired vertical depth (which is an approximation since depth on both ends of the panels is different due to their trapezoidal shape that generates the gridshell's curvature) and the offset distance between two parallel panels are design variables that a user can control. User input for the depth of the shell sets the depth at the lower end of the trapezoid.

Since the paths of forces in gridshells are generally designed to follow through the midpoints of structural elements, the loop edges typically need to be extruded vertically in both directions above and below their original axes in the input line network. Once the height of each trapezoidal panel is computed, the trapezoids are offset towards the centre of each loop to form the inner surfaces of the structural loops. The offset distance accounts for the material thickness of the walls and the desired gap size between two parallel walls.

Once the edge surfaces are extruded and populated throughout the structure, a double curved surface is formed from flat edge panels.

Figure 12:
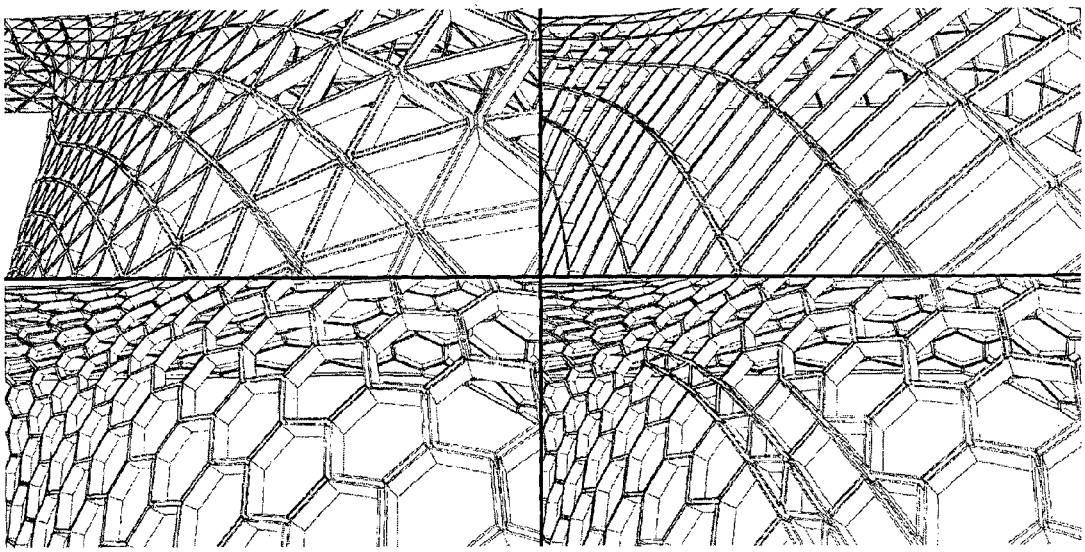
FIG. 12 shows the application of the method to achieve four different lattice patterns on an identical surface.

Embodiments of the methods can be used to generate gridshell lattices for line-networks of different curvatures and patterns. FIG. 12 shows the application of the method to achieve or obtain four different lattice patterns on an identical surface.

Embodiments of the grid structure and methods allow one to generate support structures for free-form line-networks on curved surfaces using strictly flat members, which can be cut on two-dimensional routers. Thus, it can be seen that the limitations in conventional approaches, in which either edges (e.g. beams, walls) or nodes (e.g. joints, connections) require cutting in more than two dimensions, or the network pattern is limited to rectangular grids, have been overcome in the various embodiments described.

Embodiments of the grid structure and methods may be used to generate gridshell structures for buildings (e.g. canopies, hangars, pavilions, etc.) for functions that benefit from large, unobstructed covered spaces (assembly activities, airplane covers, storage, sports activities, agricultural acitivites, etc.). Beyond structural efficiency, gridshell ceilings are also aesthetic to look at and can be applicable in various settings.

Besides full-scale architectural application, embodiments of the grid structure and methods may be used to develop, three-dimensional assembly kits, educational toys for children and architectural scale models. The method can be used to develop 3D gridshell modela in shapes of well-known buildings (e.g. Beijing Olympic Stadium and Aquatic Stadium; Allianz Arena in Munich; London City Hall etc.) that can be assembled from pre-fabricated flat sheet material (e.g. plastic, wood, or metal, or composites panels). Ensuring that all the gridshell elements are cut on simple 2D cutters (e.g. lasercutters) makes the application extremely affordable and visually spectacular.

Notwithstanding the claimed subject-matter, embodiments are also described by the following clauses:

1. A method for determining a cutting scheme for cutting a plurality of panels, so that the panels form a gridshell, the gridshell comprising a curved surface and comprising a plurality of beams, each beam comprising two parallel panels, the method comprising:

determining a representation of a surface, the representation of the surface comprising a network of edges and normal vectors, the network comprising a plurality of nodes and at least one loop of nodes, wherein each normal vector of a plurality of normal vectors is assigned to one node of the plurality of nodes;

for each loop of the at least one loop of nodes:

determining a representation of a first vector based on a first node of the respective loop and a second node of the respective loop;

determining a representation of a second vector based on a first normal vector assigned to the first node and a second normal vector assigned to the second node;

determining a first plane based on the first vector and the second vector;

determining a first offset plane based on the first plane and a first offset pointing inwards the loop;

determining a representation of a third vector based on the first node and a third node of the respective loop;

determining a representation of a fourth vector based on the first normal vector and a third normal vector assigned to the third node;

determining a second plane based on the third vector and the fourth vector;

determining a second offset plane based on the second plane and a second offset pointing inwards the loop;

determining cutting lines for a first panel and for a second panel based on an intersection of the first offset plane and the second offset plane.

2. The method of clause 1, wherein a normal vector of the plurality of normal vectors approximates a normal vector of the surface at the position of the node assigned to the normal vector.
3. The method of clause 1 or 2, wherein the first vector is determined based on a difference of the first node and the second node.
4. The method of any one of clauses 1 to 3, wherein the first vector is determined as a vector connecting the first node and the second node.
5. The method of any one of clauses 1 to 4, wherein the second vector is determined as an average of the first normal vector and the second normal vector.
6. The method of any one of clauses 1 to 5, wherein the first plane is determined as a plane having a first dimension along the first vector and having a second direction along the second vector.
7. The method of any one of clauses 1 to 6, wherein the first offset plane is determined as a plane parallel to the first plane in a distance of the first offset from the first plane.
8. The method of any one of clauses 1 to 7, wherein the third vector is determined based on a difference of the first node and the third node.
9. The method of any one of clauses 1 to 8, wherein the third vector is determined as a vector connecting the first node and the third node.
10. The method of any one of clauses 1 to 9, wherein the fourth vector is determined as an average of the first normal vector and the third normal vector.

11. The method of any one of clauses 1 to 10, wherein the second plane is determined as a plane having a first dimension along the third vector, and having a second direction along the fourth vector.
12. The method of any one of clauses 1 to 11, wherein the second offset plane is determined as a plane parallel to the second plane in a distance of the second offset from the second plane.
13. The method of any one of clauses 1 to 12, wherein the first offset is equal to the second offset.
14. The method of any one of clauses 1 to 13, wherein the cutting line is determined as the intersection of the first offset plane and the second offset plane.
15. A part for a gridshell, wherein the part comprises a panel cut according to a cutting line determined according to the method of any one of clauses 1 to 14.
16. A part for a gridshell, the part comprising:

a panel, wherein a first side of the panel is parallel to a second side of the panel, and wherein each of a third side of the panel, a fourth side of the panel, a fifth of the panel and a sixth side of the panel are perpendicular to the first side.

17. A gridshell comprising:

a plurality of beams; and a plurality of connectors, each connector comprising a linear fastener;

wherein each beam comprises two parallel panels;

wherein the panels of the plurality of beams are arranged in a plurality of loops;

wherein the two parallel panels of each beam belong to two different loops;

wherein for each panel a first side of the panel is parallel to a second side of the panel, and wherein each of a third side of the panel, a fourth side of the panel, a fifth side of the panel and a sixth side of the panel are perpendicular to the first side; and wherein in each loop, a connector of the plurality of connectors connects two panels of the loop.

18. The gridshell of clause 17, wherein each connector of the plurality of connectors connects two planes along a single intersection line and comprises at least one of a hinge, a weld, a fold, an adhesive, and a fastener.
19. The gridshell of clause 18, wherein the third side is parallel to the fourth side.
20. The gridshell of any one of clauses 17 to 19, wherein the distance between the first side and the second side is smaller than the distance between the third side and the fourth side.
21. The gridshell of any one of clauses 17 to 20, wherein the panel and the parallel further panel are provided at a pre-determined distance.
22. The gridshell of clause 21, wherein the pre-determined distance is in the order of a thickness of a spacer block that can be positioned between two parallel panels.
23. The gridshell of any one of clauses 17 to 22, further comprising:

a further connector configured to connect the two parallel panels of a beam.

24. The gridshell of clause 23, wherein the further connector comprises a spacer block.
25. A gridshell comprising a plurality of parts for a gridshell according to clause 15.
26. A gridshell comprising a plurality of parts for a gridshell according to clause 16.

It will be understood that the determinations or properties given according to a function in the above clauses (for example "average" or "difference" or "equal" or "intersection" or "parallel") may be understood as to involve a determination or a property of at least essentially the function. For example, instead of determining "a−b" for a difference of a and b, "a−b+eps" may be determined, with eps being a small positive or negative number (for example an order of magnitude smaller than a or than b or than a−b, for example at least a factor of 10 smaller than a or than b or than a−b).

A device for performing the method for determining a cutting scheme may be provided.

A panel may also be referred to as a board, plate or other element cut out of flat sheet material. The panel may be made of any material, for example wood, plastic, metal, or paper.

The distance between the first side of a panel and the second side of the panel may be the thickness of the panel.

By determining the cutting line for a plurality of panels, the panels may be used to resemble (or approximate) the surface in the form of a gridshell, wherein two panels may be provided in parallel as a beam. The beam may follow the edges of the grid. The ends of the panels may be located near the nodes of the grid.

According to the method for determining a cutting scheme, cutting lines may be determined for a first panel which may be one panel of the two parallel panels that form a beam from the first node to the second node, and, for a second panel which may be one panel of the two parallel panels that form a beam from the first node to the third node.

According to the method for determining a cutting scheme, the second vector may be determined as an average of the first normal vector and the second normal vector. For example, the direction of the second vector may be determined as an average of the first normal vector and the second normal vector.

Each panel may have a length, which may be a size of the panel at least essentially from one intersection to another intersection. Each panel may have a width, which may be a size at least essentially along the direction of the second vector. The width of each panel may be determined based on a user input; for example, a user may determine the width of each panel. The width of different panels may be different. The width of the panels may determine the thickness of the gridshell. The thickness of the gridshell may be different for different portions of the gridshell.

Each panel may have a thickness, which may be a size of the panel in a direction at least essentially orthogonal to the direction of the length of panel and at least essentially orthogonal to the direction of the width of the panel.

The thickness of each panel may have an influence of the intermediary space at the interconnection of several panels.

The thickness of each panel may be chosen so that it is thick enough to provide stability, but yet not too thick in order to avoid overlapping of several panels in a loop or at an interconnection of several panels.

By determining the cutting line according to the method for determining a cutting scheme for cutting a plurality of panels, the cutting lines for a panel may be determined. This may include determining an angle at which a side of the panel is to be cut, and furthermore may include a position on the panel at which to cut the panel at the determined angle. In other words, for a trapezoidal shape of the panel, not only the angles of the non-parallel sides may be determined, but also the lengths of the two parallel sides.

Furthermore, it will be understood that the panels may have any shape other than trapezoidal shape, as long as the angles for two sides adjacent to a side which forms the outer shape of the gridshell, are determined like described above.

The cutting lines may define the three-dimensional shape of the resulting gridshell.

At the boundaries of the surface (for example at the portions of the surface where the surface reaches ground level, or for openings such as doors or windows of the surface), the loops may be incomplete. For example, for openings, for a complete loop next to the opening, a beam may include two panels, wherein one of the two panels belongs to the complete loop, and the other one of the two panels does not belong to a complete loop. However, both of the two panels may be cut according to the method described above.

A network may also be referred to as a grid, or as a mesh.

The different lengths of two panels of a beam may influence the orientation of the beam in two dimensions, and the angle at Which the panel is cut according to the cutting line may influence the orientation of the beam in a third dimension.

The cutting line may define how to cut a panel, and the cut may be perpendicular to the first side of the panel.

Providing a part of a gridshell in which a first side of the panel is parallel to a second side of the panel, and in which each of a third side of the panel, a fourth side of the panel, a fifth side of the panel and a sixth side of the panel are perpendicular to the first side allows for easy cutting of any panel of a pre-determined thickness to be in the form of the part of the gridshell. For example, a panel may be cut by a two-dimensional (2D) cutter, in which the cutting is always performed perpendicular to the first side and the second side, so that only two coordinates (which may be determined according to the cut line) may be required to identify the cut, and so that standard 2D cutters, like a laser-cutter, water-jet cutter, turret-cutter, flat-bed CNC cutter, circular saw, a buzz saw, a band saw, a belt saw, a coping saw, a fretsaw, a inlay saw, a jigsaw, a scroll saw, or any other kind of saw may be used.

In a loop of nodes, there may be edges from one node to another node. The edges may intersect only at the nodes. For example, nodes and edges of the loop may define a polygon. For example, the angle of two edges may be less than 180 deg (or less than pi rad). It will be understood that an edge of the loop may define a direction pointing outwards the polygon (in other words: outwards the loop) and a direction pointing inwards the polygon (in other words: inwards the loop).

It will be appreciated by a person skilled in the art that numerous variations and/or modifications may be made to the present invention as shown in the embodiments without departing from a spirit or scope of the invention as broadly described. The embodiments are, therefore, to be considered in all respects to be illustrative and not restrictive.

The invention claimed is:

1. A grid structure formed from a plurality of building blocks, the grid structure comprising:

a plurality of flat panels, wherein two of the plurality of flat panels are paired in parallel to have one of the two parallel flat panels provide an inner surface to one building block from the plurality of building blocks and the other of the two parallel flat panels provide an inner surface to another building block from the plurality of building blocks, wherein within each of the plurality of building blocks, inner surfaces of the building block provided by any two adjacent panels lie on planes that intersect along a straight line, defined by edges of the two adjacent panels, that passes through an inner corner of the building block, wherein at a location where corners of two or more of the plurality of building blocks meet, the straight lines that pass through the inner corners of adjacent building blocks each lie on axes that have different angles to one another, wherein within at least two of the plurality of flat panels that are paired, the edges of the paired flat panels which are closest each lie on axes that have different angles to one another.

2. The grid structure of claim 1, wherein the plurality of building blocks comprises different polygonal structures.

3. The grid structure of claim 2, wherein the polygonal structures comprises any one or more of the following shapes: triangular, quadrilateral, pentagonal and hexagonal.

4. The grid structure of claim 1, wherein two opposite edges of each of the plurality of building blocks that connect two corners of each of the plurality of building blocks are parallel.

5. The grid structure of claim 1, wherein each of two opposite edges of each of the plurality of building blocks that connect two corners of each of the plurality of building blocks are curved or straight.

6. The grid structure of claim 1, wherein the perimeter of each of the plurality of flat panels is derived from a perpendicular cut.

7. The grid structure of claim 1, wherein the two parallel flat panels are connected by a spacer disposed between the two parallel flat panels.

8. The grid structure of claim 1, wherein the two parallel flat panels are directly connected.

9. The grid structure of claim 1, wherein the grid structure is a gridshell.

10. The grid structure of claim 1, wherein the two flat panels, providing the two inner surfaces that lie on planes intersecting along a straight line that passes through the inner corner of the building block, are coupled together by a linear joint selected from a group comprising a hinge, a weld, a fold, an adhesive, and a fastener.

11. A method for determining geometry of a flat panel, wherein two of a plurality of flat panels are paired in parallel to have one of the two parallel flat panels provide an inner surface to one building block from a plurality of building blocks of a grid structure and the other of the two parallel flat panels provide an inner surface to another building block from the plurality of building blocks of the grid structure, the method comprising:

obtaining a line network representation of the grid structure, the line network comprising a plurality of nodes where adjacent nodes are connected by an edge, wherein a line representation of each of the building blocks is formed by three or more edges connected in a loop;

determining a normal for each of the edges;

constructing a plane for each of the edges, wherein the normal of the edge and the edge lie on the plane;

offsetting the plane inward of the loop, the offset being along an axis that is perpendicular to the plane, wherein the offset plane is used to construct the inner surface of the flat panel, the inner surface facing inward of the loop; and determining a straight line along which the offset planes intersect, wherein two of the inner surfaces of two of the adjacent flat panels from the same loop lie on the offset planes, wherein the straight line passes through an inner corner of each of the plurality of building blocks, wherein at a location where the corners of two or more of the plurality of building blocks meet, the straight lines that pass through the inner corners of adjacent building blocks each lie on axes that have different angles to one another.

12. The method of claim 11, wherein the step of offsetting the plane further comprises determining an amount to offset by taking into consideration the thickness of the flat panel and the gap between the two parallel flat panels.

13. The method of claim 11, wherein the step of determining a normal for each of the edges further comprises the step of:

determining node normals on both ends of each of the edges based on a surface curvature of the grid structure; and obtaining the edge normal by averaging the node normal on both ends of each of the edges.

14. The method of claim 11, further comprising the step of extruding the surface of the flat panel in a direction outward of the loop by the desired thickness of the flat panel to obtain a three dimensional geometry representation of the flat panel.

15. A method for constructing a grid structure formed from a plurality of building blocks, the method comprising:

forming the plurality of building blocks by having, within each of the plurality of building blocks, two inner surfaces of any two adjacent panels lie on planes intersecting along a straight line that passes through an inner corner of the building block; and joining the plurality of building blocks by pairing two of a plurality of flat panels, each from a different building block, in parallel, to have one of the two parallel flat panels provide an inner surface to one building block from the plurality of building blocks and the other of the two parallel flat panels provide an inner surface to another building block from the plurality of building blocks, wherein at a location where the corners of two or more of the plurality of building blocks meet, the straight lines defined by edges of the two adjacent panels that pass through the inner corners of adjacent building blocks each lie on axes that have different angles to one another, wherein within at least two of the plurality of flat panels that are paired, adjacent edges of the flat panels each lie on axes that have different angles to one another, and wherein within at least two of the plurality of flat panels that are paired, the edges of the paired flat panels which are closest each lie on axes that have different angles to one another.

16. The method of claim 15 further comprising:

determining the geometry of each of the plurality of the flat panels; and cutting sheet material perpendicularly to obtain the flat panels.

17. The method of claim 16, wherein the step of determining the geometry of the flat panel further comprises:

obtaining a line network representation of the grid structure, the line network comprising a plurality of nodes where adjacent nodes are connected by an edge, wherein a line representation of each of the building blocks is formed by three or more edges connected in a loop;

determining a normal for each of the edges;

constructing a plane for each of the edges, wherein the normal of the edge and the edge lie on the plane; and offsetting the plane inward of the loop, the offset being along an axis that is perpendicular to the plane, wherein the offset plane is used to construct the inner surface of the flat panel, the inner surface facing inward of the loop, wherein each of the straight lines that pass through the inner corners of adjacent building blocks is formed by determining, within two of the inner surfaces of two of the adjacent flat panels from the same loop that lie on the offset planes, a straight line along which the offset planes intersect.

18. The method of claim 15, wherein the step of forming the plurality of building blocks by having, within each of the plurality of building blocks, two of the inner surfaces of any two adjacent panels lie on planes intersecting along the straight line that passes through the inner corner of the building block further comprises coupling the two flat panels, that provide the two inner surfaces, using a joint selected from a group comprising a hinge, a weld, a fold, an adhesive, and a fastener.

19. The method of claim 15, wherein the step of joining the plurality of building blocks by pairing two of the plurality of flat panels in parallel further comprises disposing a spacer between the two parallel flat panels.

20. The method of claim 15, wherein the step of joining the plurality of building blocks by pairing two of the plurality of flat panels in parallel further comprises directly connecting the two parallel flat panels.

* * * * *